US008291513B2

(12) United States Patent
Prinkey

(10) Patent No.: US 8,291,513 B2
(45) Date of Patent: Oct. 23, 2012

(54) COUNTER BALANCED, HANDS FREE, SELF POSITIONING, PROTECTIVE SHIELD

(75) Inventor: Stephen John Prinkey, Philadelphia, PA (US)

(73) Assignee: Stephen John Prinkey, Philadelphia, PA (US)

( * ) Notice: Subject to any disclaimer, the term of this patent is extended or adjusted under 35 U.S.C. 154(b) by 159 days.

(21) Appl. No.: 12/799,129

(22) Filed: Apr. 19, 2010

(65) Prior Publication Data

US 2011/0185465 A1 Aug. 4, 2011

Related U.S. Application Data

(60) Provisional application No. 61/214,002, filed on Apr. 18, 2009.

(51) Int. Cl.
*A61F 9/00* (2006.01)

(52) U.S. Cl. ..... 2/15; 2/6.5

(58) Field of Classification Search ..... 2/6.2, 6.3, 2/6.7, 8.2, 8.3, 9, 10, 12, 422, 424, 15, 6.5; 473/210, 211
See application file for complete search history.

(56) References Cited

U.S. PATENT DOCUMENTS

| | | | | | |
|---|---|---|---|---|---|
| 1,182,367 | A | * | 5/1916 | Gravell | 2/8.2 |
| 1,601,830 | A | * | 10/1926 | Huntsman | 2/8.2 |
| 1,833,257 | A | * | 11/1931 | Norton | 2/8.3 |
| 2,103,006 | A | * | 12/1937 | Helfenstein et al. | 2/8.2 |
| 2,411,831 | A | * | 11/1946 | Lehmberg et al. | 2/181 |
| 2,487,183 | A | * | 11/1949 | Rohlf | 2/8.1 |
| 2,544,457 | A | * | 3/1951 | Harrington | 2/8.1 |
| 2,761,046 | A | * | 8/1956 | Herrick et al. | 219/147 |
| 2,763,006 | A | * | 9/1956 | Amundsen | 2/8.1 |
| 3,050,735 | A | * | 8/1962 | Newman et al. | 2/6.5 |
| 3,273,164 | A | * | 9/1966 | Thomas | 2/10 |
| 4,392,650 | A | * | 7/1983 | Hilton | 473/464 |
| 4,928,324 | A | * | 5/1990 | Evans et al. | 2/424 |
| 5,009,496 | A | * | 4/1991 | Holtan et al. | 351/156 |
| 5,189,735 | A | * | 3/1993 | Corona | 2/8.3 |
| 5,230,101 | A | * | 7/1993 | Hedges et al. | 2/424 |
| 5,604,930 | A | * | 2/1997 | Petit et al. | 2/6.5 |
| 5,652,954 | A | * | 8/1997 | Paiement et al. | 2/10 |
| 5,752,280 | A | * | 5/1998 | Hill | 2/453 |
| 5,901,369 | A | * | 5/1999 | Pilney | 2/6.5 |
| 6,041,435 | A | * | 3/2000 | Paulson et al. | 2/10 |
| 6,807,679 | B1 | * | 10/2004 | Wang-Lee | 2/10 |
| 2003/0000001 | A1 | * | 1/2003 | McDonald et al. | 2/6.3 |

FOREIGN PATENT DOCUMENTS

DE 29713933 U1 * 12/1997

OTHER PUBLICATIONS

Brecht, T. Translation Abstract DE29713933U1, Gravity operated welding visor used in arc welding, but also by spot welding, autogenous welding, seam welding and other fusion welding methods permits visor opening and closing by slight head movements, Dec. 1997, p. 1.*

* cited by examiner

*Primary Examiner* — Khoa Huynh
*Assistant Examiner* — Brieanna Fuller

(57) ABSTRACT

One embodiment of a shield assembly that automatically positions itself into a user's field of view when the user tilts their head up to look skyward, protecting their face and eyes from hazards from above such as falling debris and dangerous UV rays and returns to a position out of the user's field of view when the user resumes looking forward. The same embodiment provides for a hands free method of lowering and raising the visor assembly in and out of the user's field of view by simply tilting their head. The same embodiment also provides for a one finger operation to lock the visor into a desired position.

14 Claims, 16 Drawing Sheets

COUNTER BALANCED, HANDS FREE, SELF POSITIONING, PROTECTIVE SHIELD

CROSS-REFERENCE TO RELATED APPLICATIONS

This application claims the benefit of provisional patent application Ser. No. 61/214,002, filed 2009 Apr. 18 by the present inventor.

FEDERALLY SPONSORED RESEARCH

Not Applicable

SEQUENCE LISTING OR PROGRAM

Not Applicable

BACKGROUND OF THE INVENTION

1. Field

This application relates to protective shields and visors for the face and eyes.

2. Prior Art

Many occupations require workers to wear shields or visors to protect the face and eyes from threats such as falling objects, flying debris, sparks, splashing fluids bright lights etc. Additionally, according to many experts, gazing directly at the sun or regularly looking skyward may cause solar retinopathy and damage to the retina. This repeated exposure may manifest as decreased visual acuity or small blind spots in the visual field. Also, ultraviolet rays from sunlight may accelerate the development of cataract and macular degeneration. The use of ultraviolet protection is recommended to help minimize risk of vision loss. There have been several previous attempts in the prior art to provide for an appropriate pivotal or retractable face shield for protection against accidental and incidental injuries—for example U.S. Pat. No. 4,432,100 (1984) to Bates, which is shield that is retracted up inside the concave cavity of a hardhat. Bates' shield relies on a specific configuration of the hardhat's inner headband and cannot be used universally with other types of caps or helmets. Furthermore because of the shields proximity to the face, it would be impossible to use Bates' visor in conjunction with supplemental eyewear such as reading glassed, sunglasses, safety glasses or additional protective eyewear.

There have been many attempts to provide for an adequate visor/shield assembly. Some have flipped up, some are retracted but, all previous attempts require the user to manually position the visor into place with the use of the hands. This is a drawback, since most of the time when employing an apparatus of this type, the worker's both hands are usually occupied with the task at hand. This task could be holding a heavy tool, holding two pieces of material together, mixing chemicals, holding a writing instrument with one hand while holding a writing pad with the other hand. In order for the user to position the visor between up and down position, he or she must abandon one of the tasks being performed by one or both of their hands. Some welding helmets are designed so that a quick downward nod of the head will position the helmet into place, but in order to position the helmet out of the field of view, the user is required to manually lift the protective shield.

Thus it can be seen that the prior art has failed in many crucial respects to provide a visor that permits the user to position the visor between up and down position without the use of hand manipulation. Furthermore, most previous visors/shields are dependent on being specifically mounted to a hardhat or cap respectively. Previous art also required some modification to the cap or helmet in order to be properly mounted.

Additionally some occupations require the worker to regularly gaze skyward, which not only makes their face and eyes vulnerable to falling debris but also exposes their eyes and facial skin to dangerous UV radiation and falling debris. Some occupational examples are: Roofers, Iron workers, Builders, Tree cutters, Sign Installers, Building Inspectors, Ceiling Removers, Painters, Drywall Installers, Electric Utility Technicians Etc.

Furthermore there are other occupations that require a worker's eyes to be shielded while performing tasks that are only present below eye level. These occupations include, but are not limited to, welders, steel grinders and chemists. Dangers such as sparks from a grinder, blinding light from welding, or burns from chemical splashes are some of the hazards that these workers may encounter.

Traditional protective shields, sun glasses, safety glasses, and goggles do offer some protection from these hazards. However, when the worker is not looking skyward, or is not performing a task that will expose the workers face and eyes to such hazards, the visor needs to positioned out of the field of view in order for the worker to perform detailed tasks at eye level. These detailed tasks may include, but are not limited to, filling out forms, reading electronic meters, locating tools, reading instructions or blueprints, taking measurements and so on. While performing these detailed tasks the worker may not need or want the protection of the eyewear.

While wearing tinted shields or sunglasses, it is more difficult to accomplish these detailed tasks that do not require the use of eye protection, because vision is noticeably diminished by the tinted surface of the shield or eyewear. Furthermore clear vision may be even more obscured by shield surfaces that have become dusty, scratched, or covered with liquid droplets as a result of performing the task that required the protection of eyewear itself.

While wearing traditional shields or eye protection the worker may need to reposition the vision obscuring eye protection or shield in order to see clearly. It is impractical for a worker to manually reposition the obscuring shield in and out of their field of view every time the worker needs to transition from using the protective shield to performing detailed tasks at eye level that do not warrant the use of eye or face protection. Also, the worker, in some cases, may be using both hands to accomplish the task at hand and may not have the ability to reposition the protective eyewear in and out of their field of view This device protects a worker from the dangerous UV rays of the sun and falling debris when the worker is required to look skyward. It also protects a worker from hazards that may come from below such as flying sparks or bright light from welding or cutting metal. At the same time it allows the worker to see unencumbered in low light or when the worker needs to perform detailed tasks at eye level and provides for a hands free method of operation to reposition the protective eyewear in and out of their field of view. Using this device, the transition from shielded protection to unencumbered vision does not require the worker to manually reposition the shield by using their hands. The transition is performed merely by tilting the their head, the positioning of the shield is performed by gravity and the principles of "counterbalance".

SUMMARY

In accordance with one embodiment, a shield assembly that is positioned in and out of a user's field of view without any hand manipulation.

DRAWINGS—FIGURES

In the drawings, some closely related components have the same numbers but different alphabetic suffixes.

FIG. 1*a* is a black and white illustration of the visor apparatus in the "up position" and "counterbalanced/self-positioning mode" with the user looking forward.

FIG. 1*b* is a black and white illustration of the visor apparatus in the "down position" and in "counterbalanced/self-positioning mode" with the user looking skyward.

FIG. 1*c* is a black and white illustration of the visor apparatus in the "down position" and "locked mode" with the user looking forward.

FIG. 1*d* is a black and white illustration of the visor apparatus in the "mid position" and "locked mode" with the user looking forward.

Figure 8:
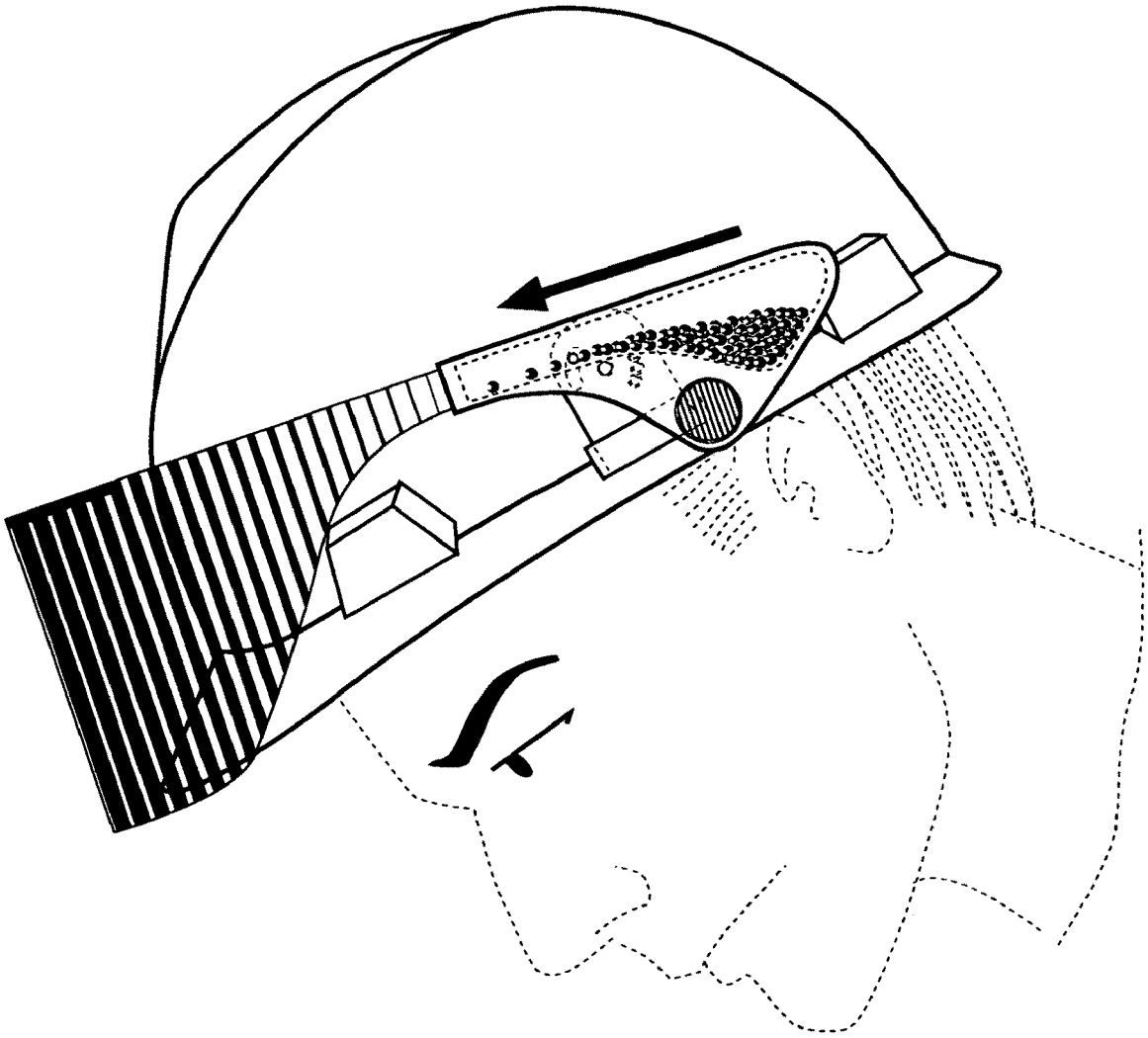
FIG. 8 shows the physics and operation of the visor apparatus when the said apparatus is in "counterbalanced/self-positioning mode" and the user begins to tilt his head forward to look down.
Figure 8A:
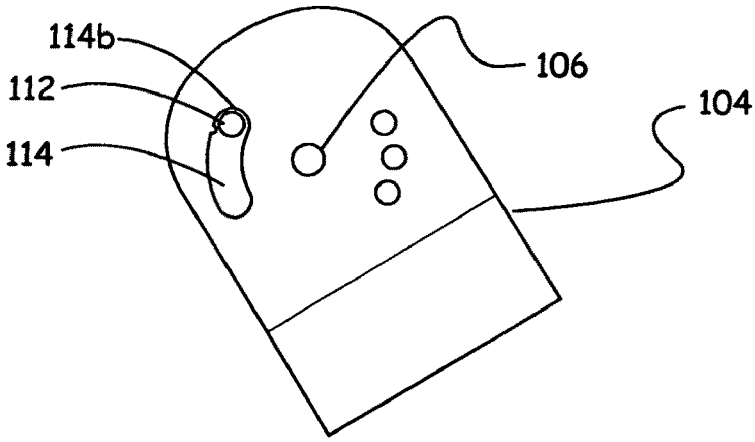

FIG. 8*a* is a detail showing the relative position of the mounting block limiting slot to visor assembly's limiting pin as illustrated in FIG. 8.

Figure 9:
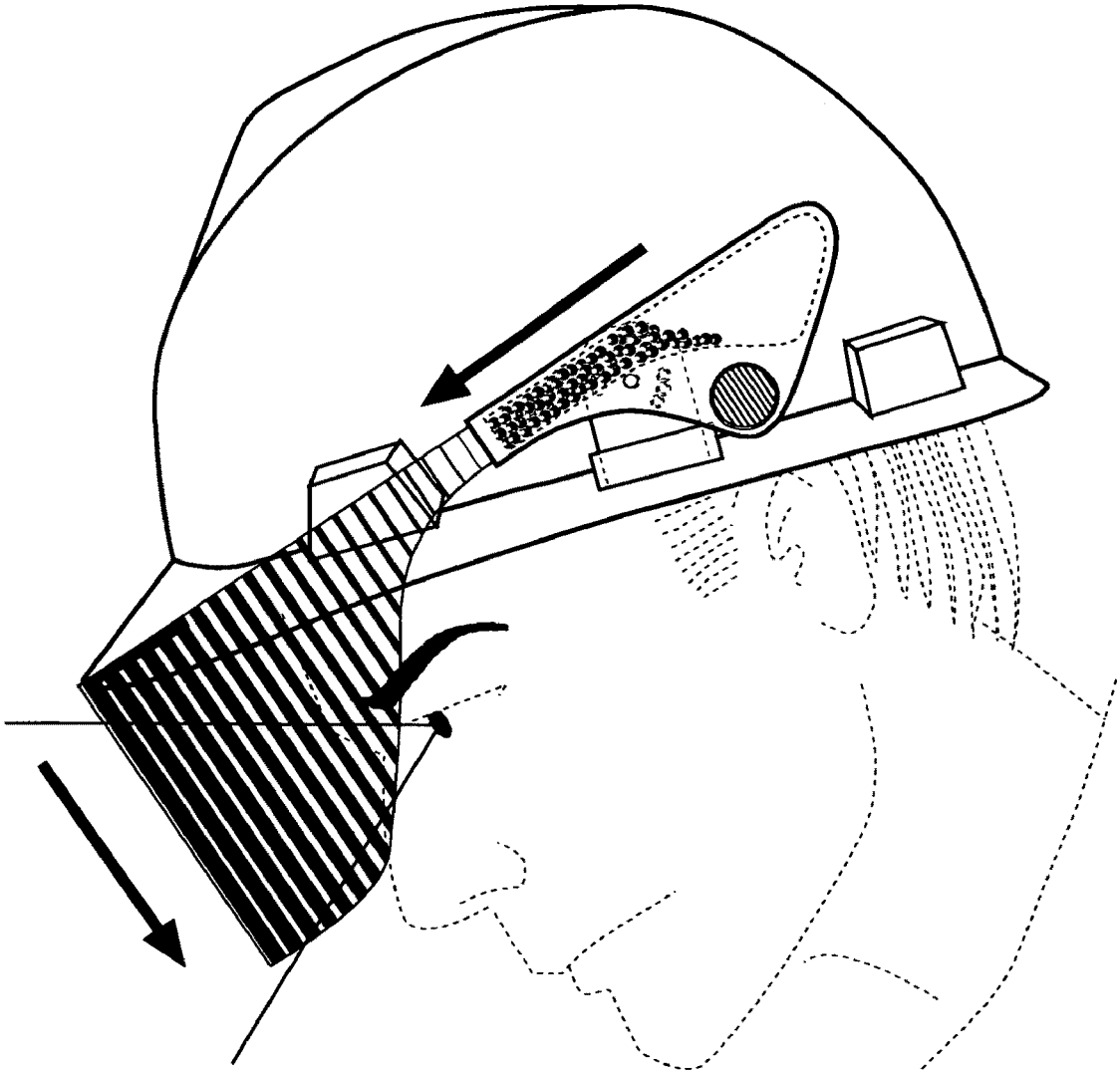

FIG. 9 shows the physics and operation of the visor apparatus when the said apparatus is in "counterbalanced/self-positioning mode" and the user is looking down.

Figure 9A:
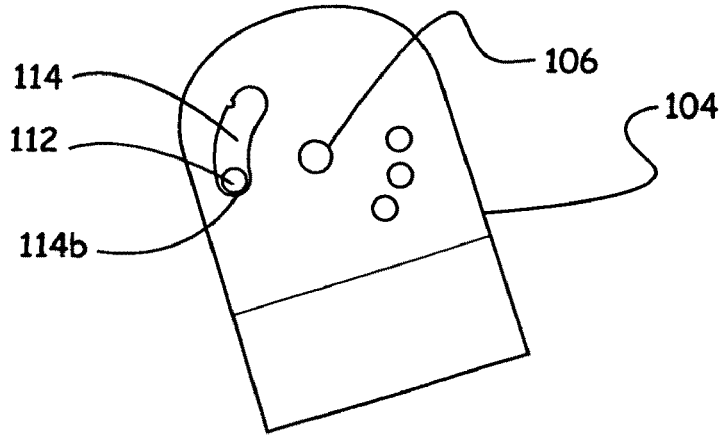

FIG. 9*a* is a detail showing the relative position of the mounting block limiting slot to the visor assembly's limiting pin as illustrated in FIG. 9

Figure 10:
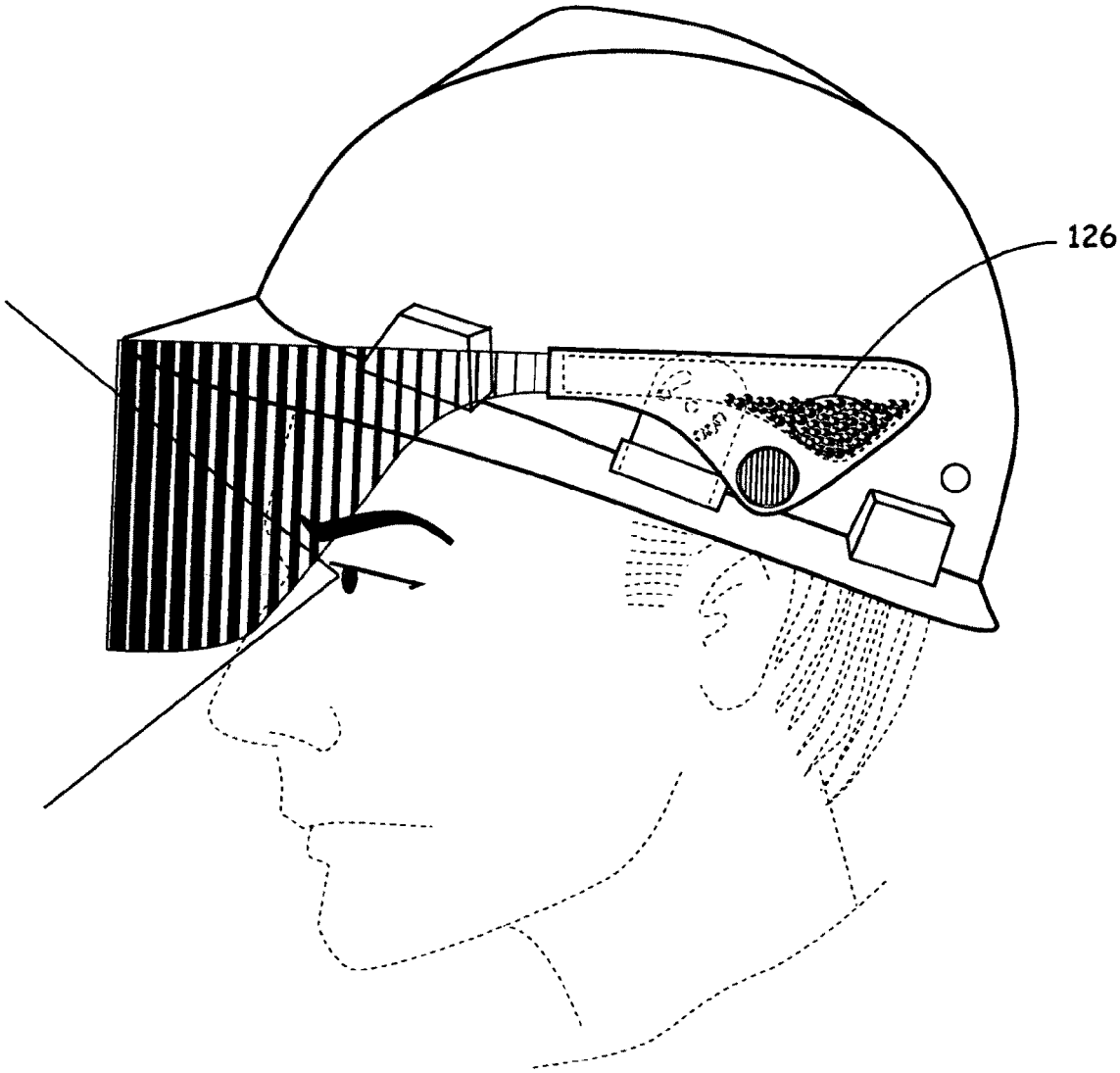

FIG. 10 show the physics and operation of the visor apparatus when the said apparatus is in "counterbalanced/self-positioning mode" and the user begins to look up, after looking down.

Figure 11:
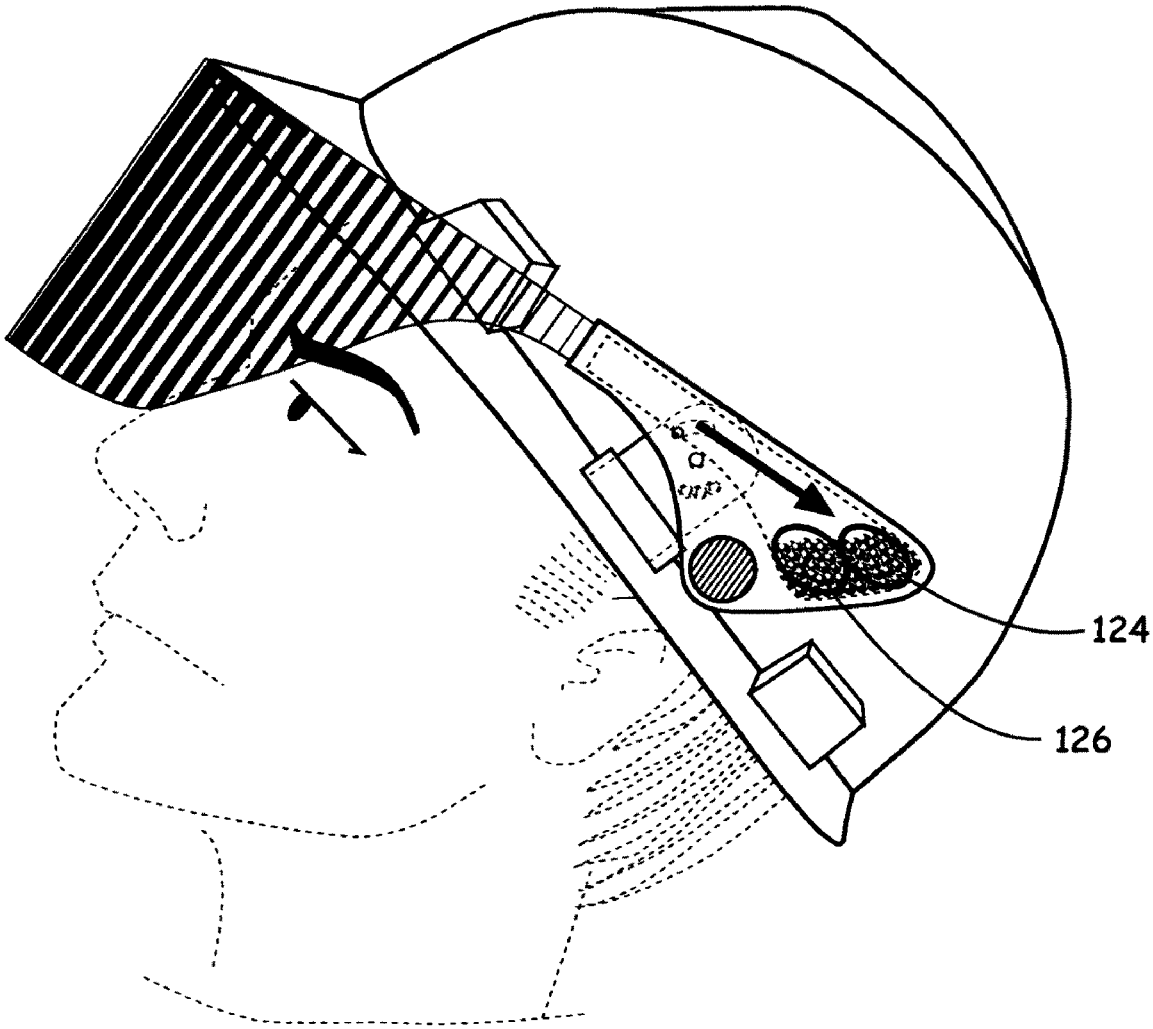

FIG. 11 shows the physics and operation of the visor apparatus when the said apparatus is in "counterbalanced/self-positioning mode" and the user is looking up to raise the visor out of their field of view.

Figure 12:
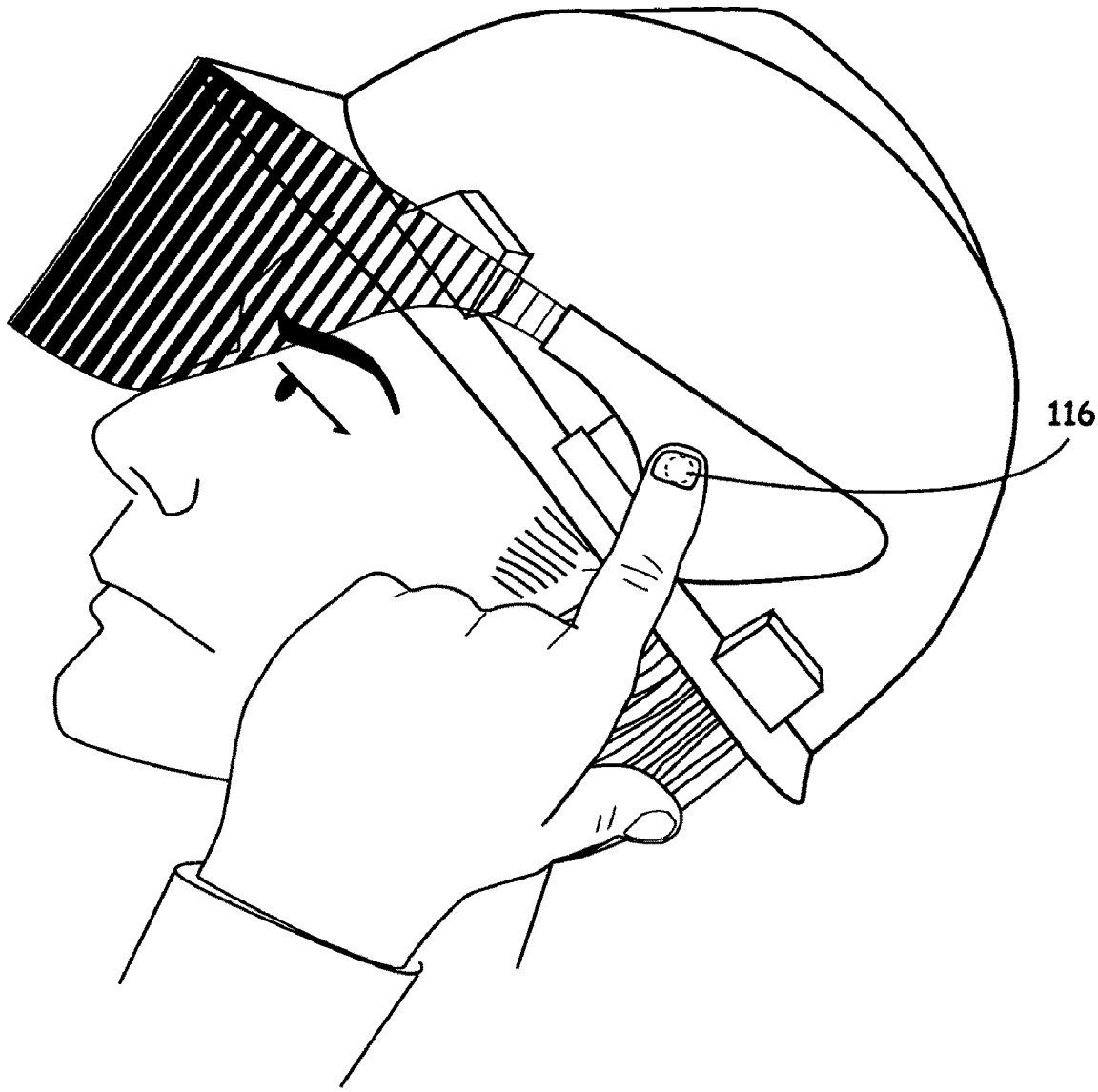

FIG. 12 shows the user depressing the locking peg to lock the visor in "down position".

Figure 13:
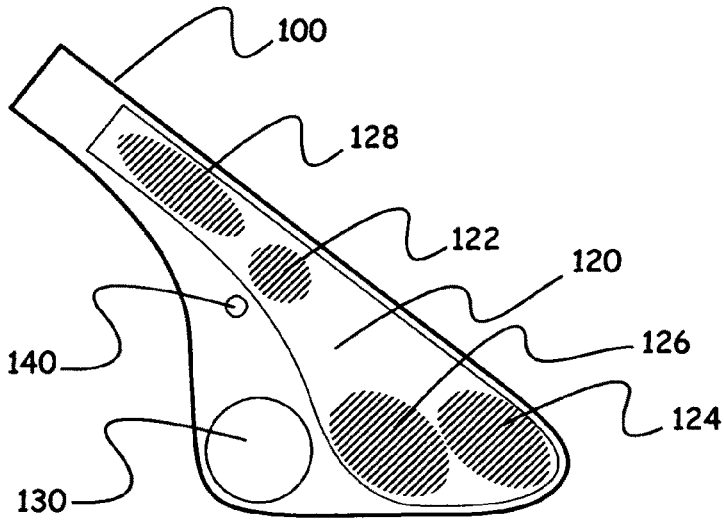

FIG. 13 shows the different areas of the housing's main cavity.

Figure 14:
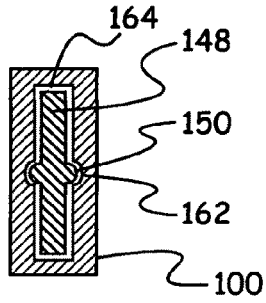

FIG. 14 shows a cross section of the shields mounting tab and how it is inserted into the housing.

Figure 15:
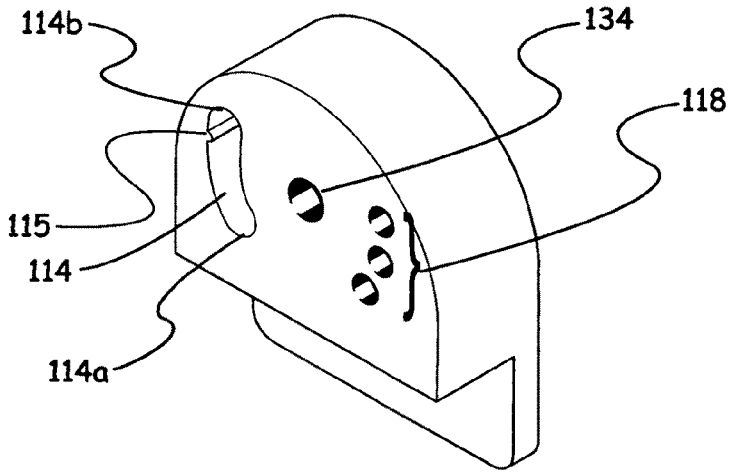

FIG. 15 shows a detail of the mounting block described in this embodiment.

Figure 16:
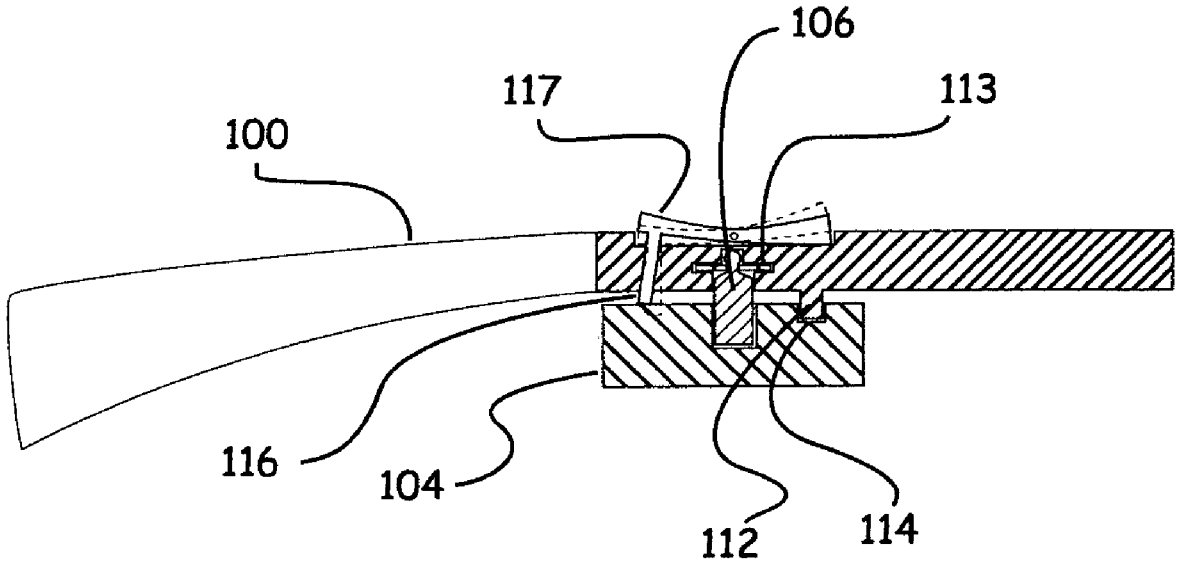

FIG. 16 shows an alternative embodiment of the locking mechanism, pivot arm, and pivot arm attachment.

Figure 17:
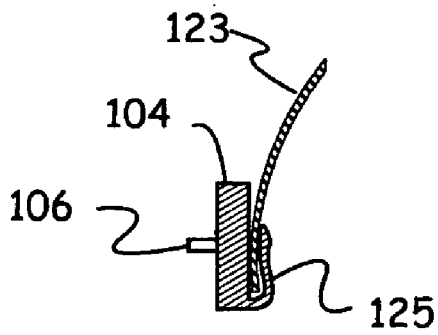

FIG. 17 shows an alternative embodiment of the mounting block and how it might attach to a cap or hat.

Figure 18:
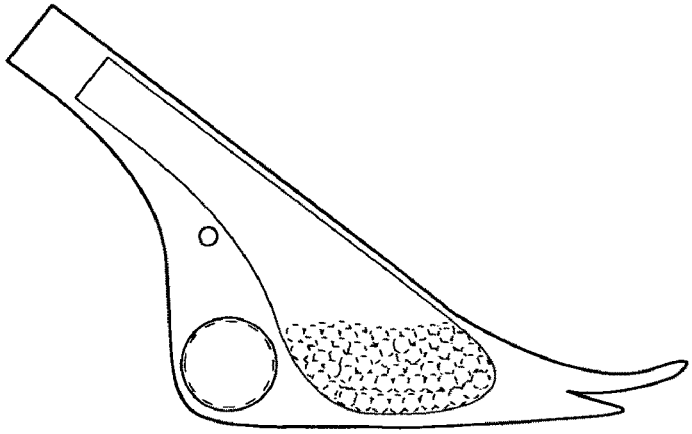

FIG. 18 shows an alternative embodiment of the weight housing's aesthetic shape.

Figure 19:
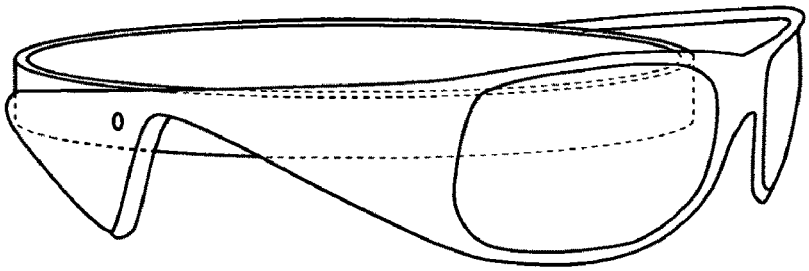

FIG. 19 shows an alternative embodiment when the mechanism is used with other types of eyewear such as sunglasses and incorporates a headband as a mounting device.

Figure 20:
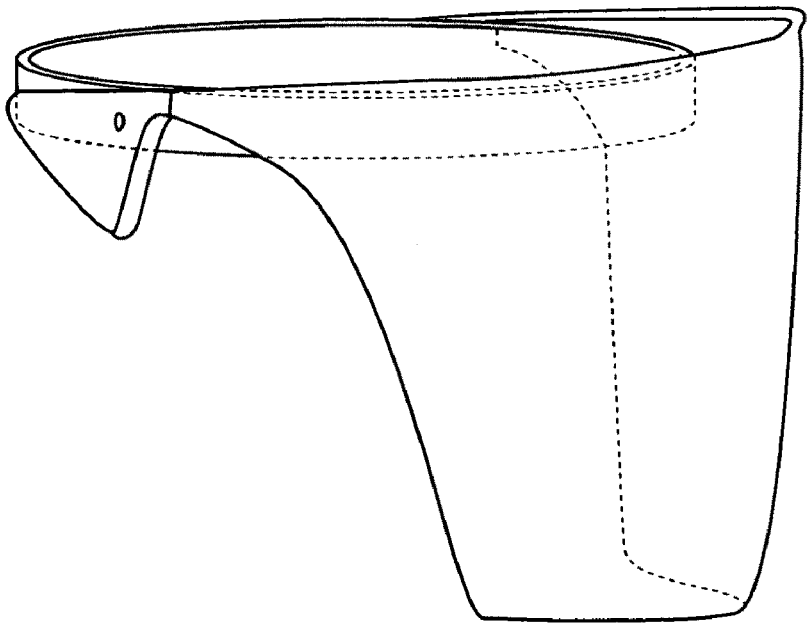

FIG. 20 shows an alterative embodiment when the mechanism is used with a splash shield and incorporates a headband as a mounting device.

DRAWINGS—REFERENCE NUMERALS

98 Visor Assembly
99 Weight Housing Assembly
100 Weight Housing
101 Hardhat
102 Shield
103 Predetermined Angle
104 Mounting Block
105 Center of Gravity
106 Pivot Arm
107 Horizontally Level Plane
108 Shifting Weights
110 Pendulum
112 Limit Pin
113 "C" Clip
114 Limit Slot
114*a* Lower Limiting Surface
114*b* Upper Limiting Surface
115 Limit Slot Protrusion
116 Locking Peg
117 Rocker Button
118 Lock Holes
118*a* Down Position Locking Hole
118*b* Mid locking Hole
118*c* Up Position Locking Hole
120 Cavity
122 Cavity (Center of Gravity)
123 Baseball Cap
124 Cavity (Rear Area)
125 Clip
126 Cavity (Mid Area)
128 Cavity (Forward Area)
130 Pendulum weight Cavity
132 Housing Cover
134 Mounting Block Pivot Hole
136 Washer
138 Mounting Block Tab
140 Housing Pivot Hole
142 Pivot Arm Retaining Nut
144 Locking Peg Hole in Housing Cover
146 Shield Top Lip
148 Shield Retaining Tab
150 Shield Retaining Tab Protrusion
152 Housing Cover Screw
154 Receiving Slot in Hardhat
156 Mounting Block Seating Surface
158 Hardhat Slot Seating Surface

160 Locking Peg Retaining "C" Clip
162 Housing Shield retaining Dimple
164 Shield Receiving Slot
166 Housing Shield Guide Groove

DETAILED DESCRIPTION—FIRST EMBODIMENT

Figure 1A:
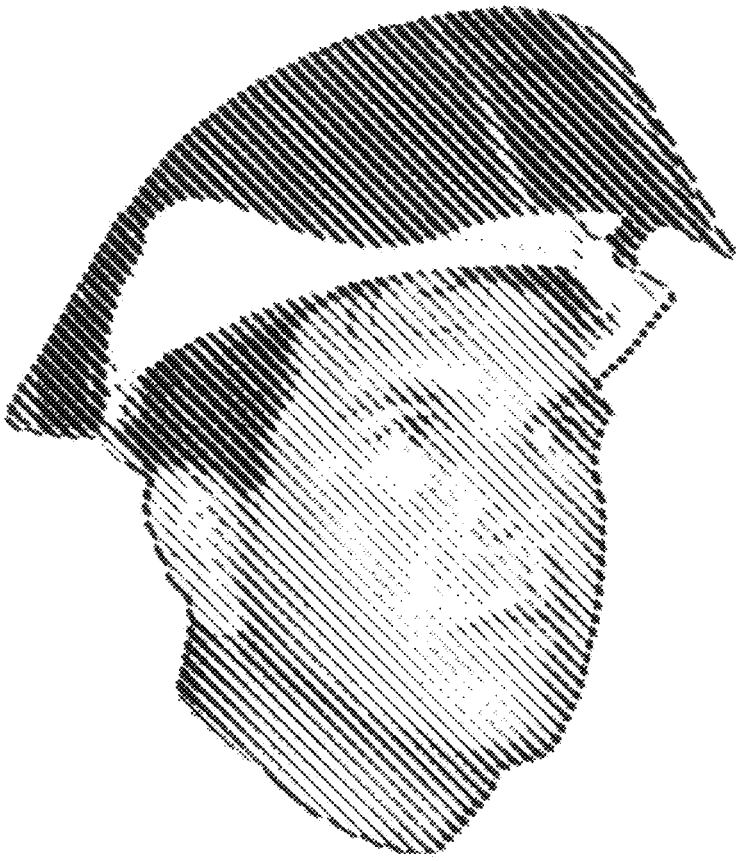
Figure 1B:
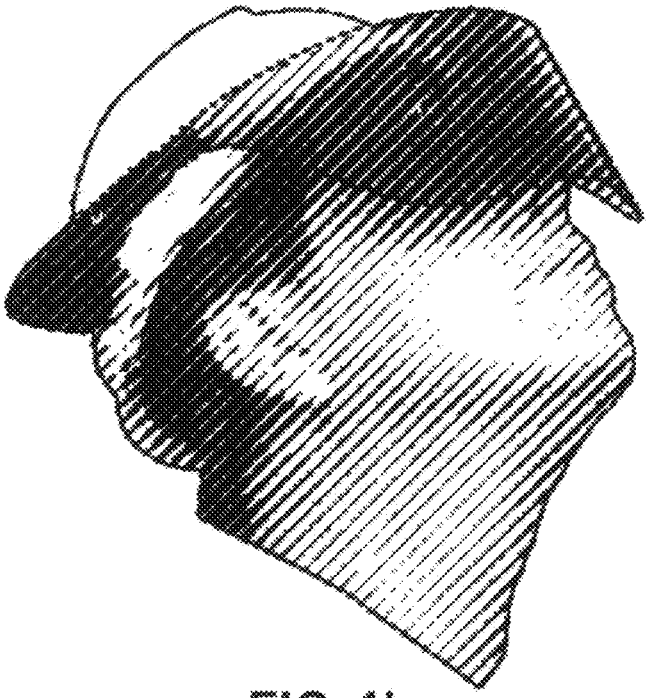
Figure 1C:
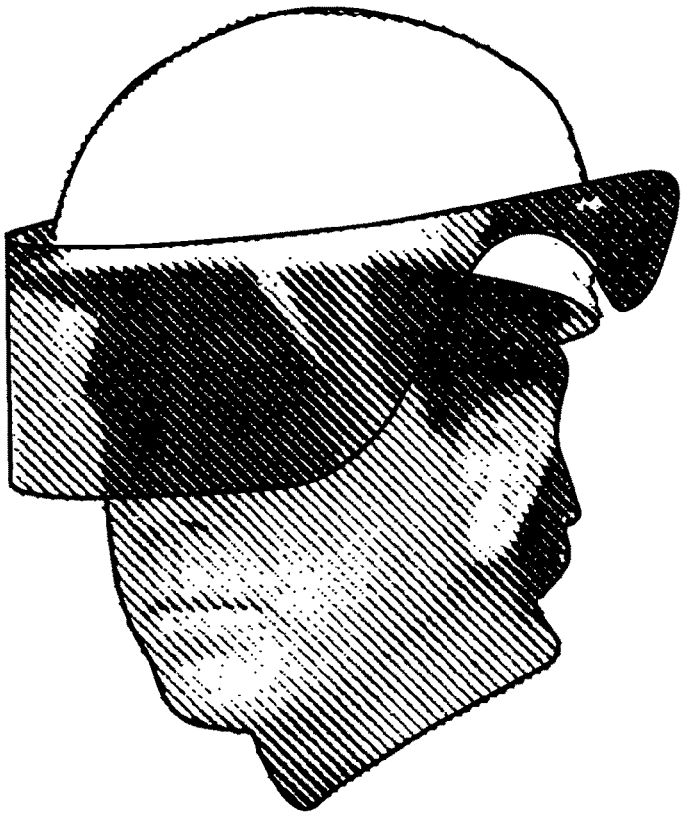
Figure 1D:
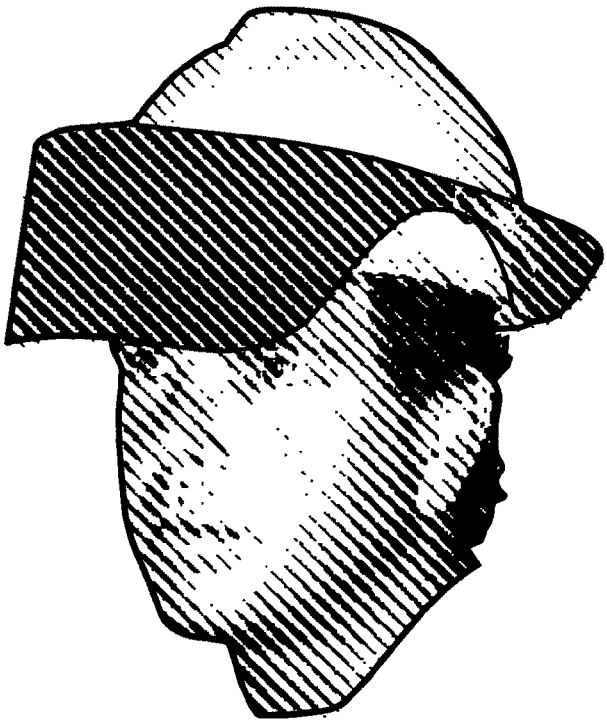
Figure 2:
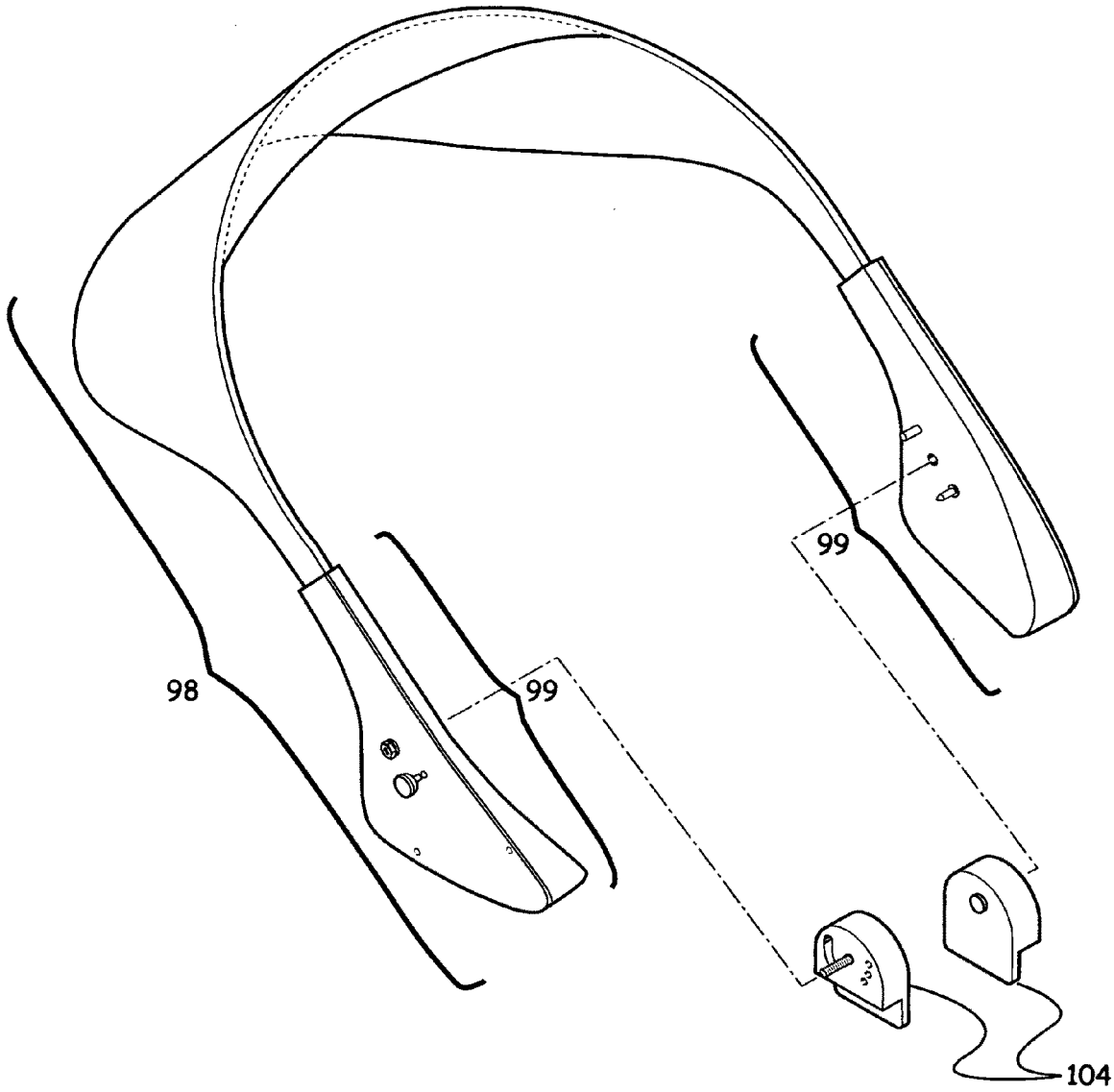
FIG. 2 shows the major components of the visor apparatus which are the shield, housing assembly and mounting block, and how they relate to, and are attached to each other in this described embodiment.
Figure 3:
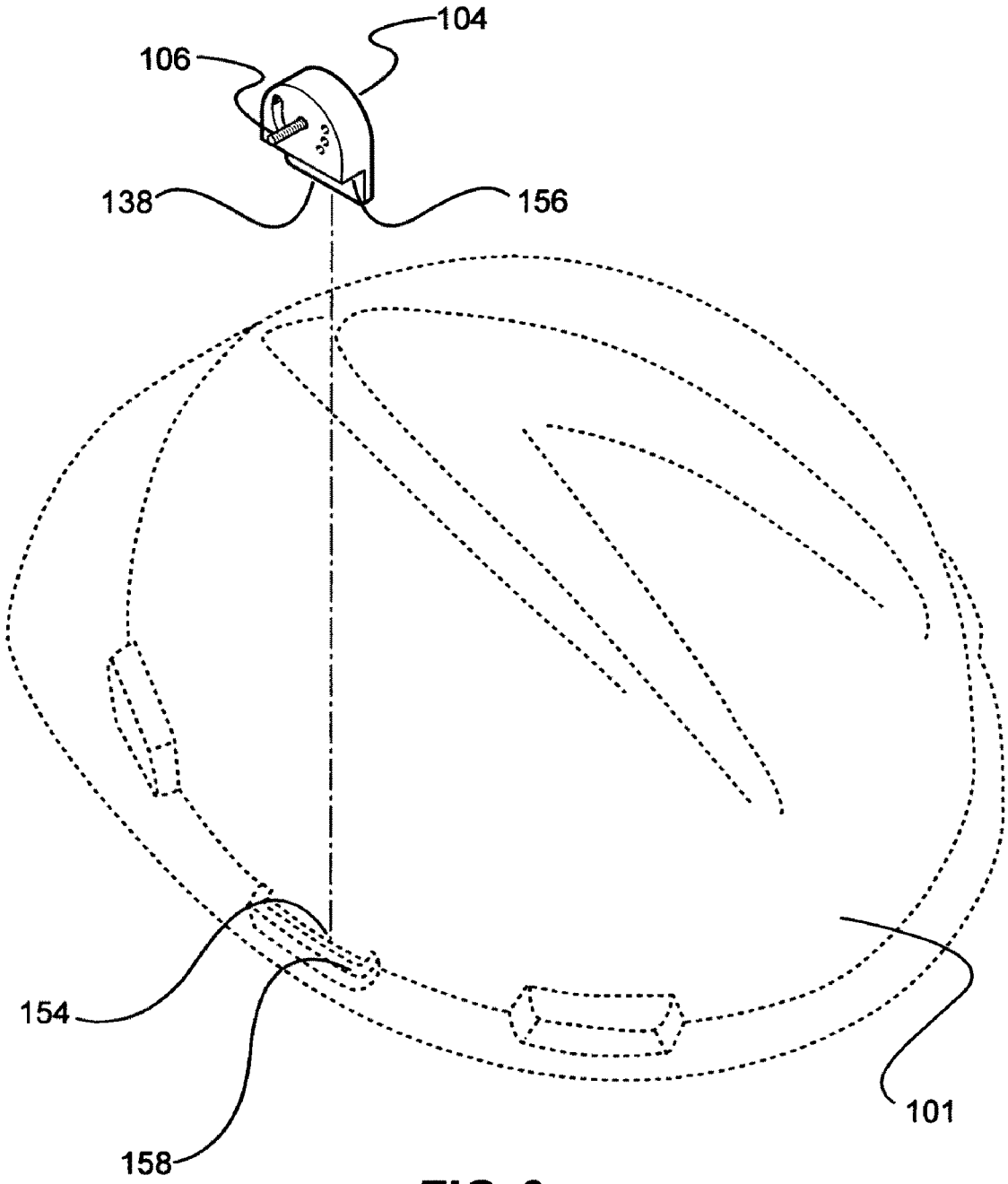
FIG. 3 shows how the mounting block described in the preferred embodiment fits into a standard hardhat.
Figure 4:
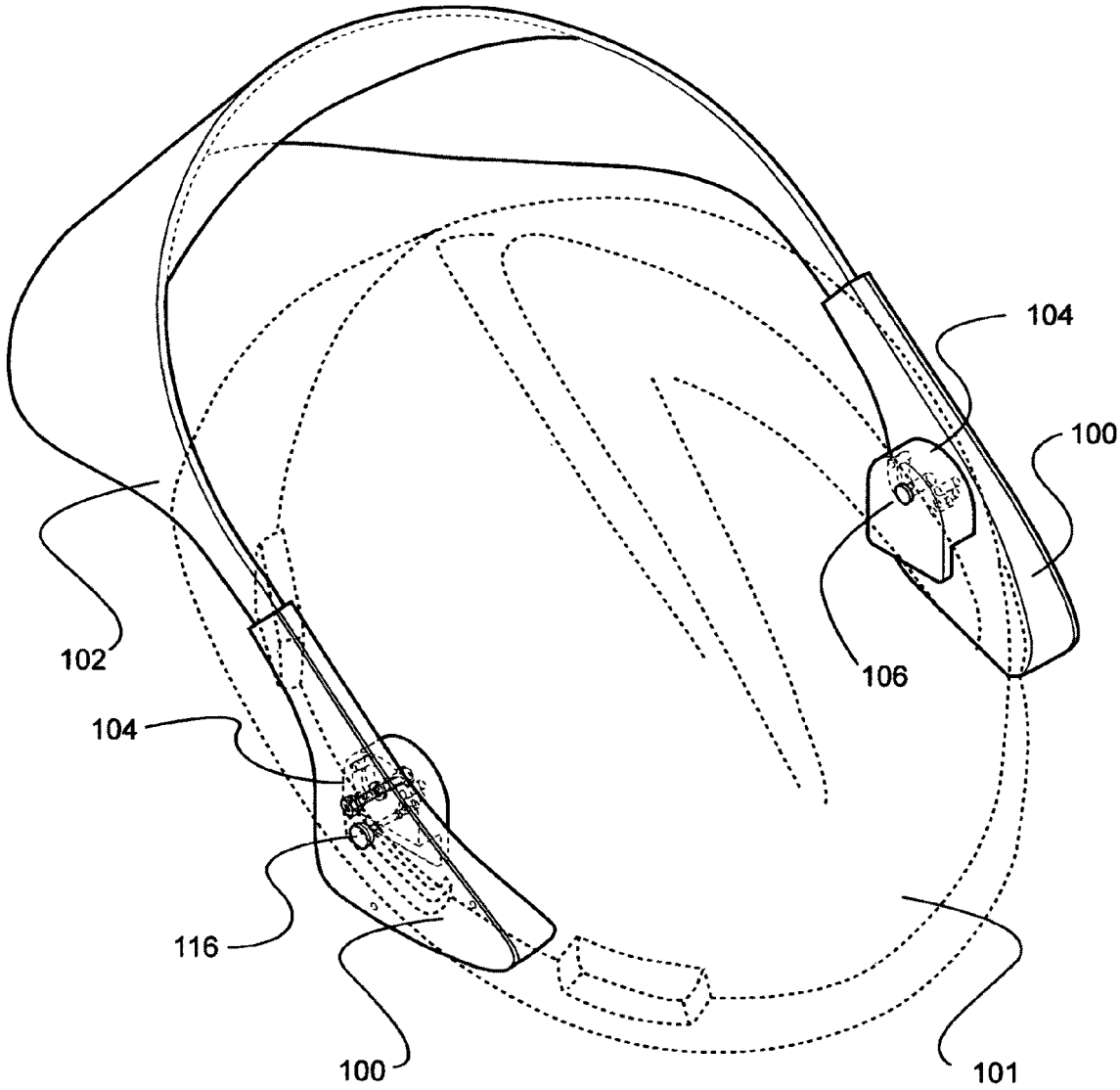
FIG. 4 shows an assembled visor apparatus as described in this application and how it relates to a standard hardhat.
Figure 5:
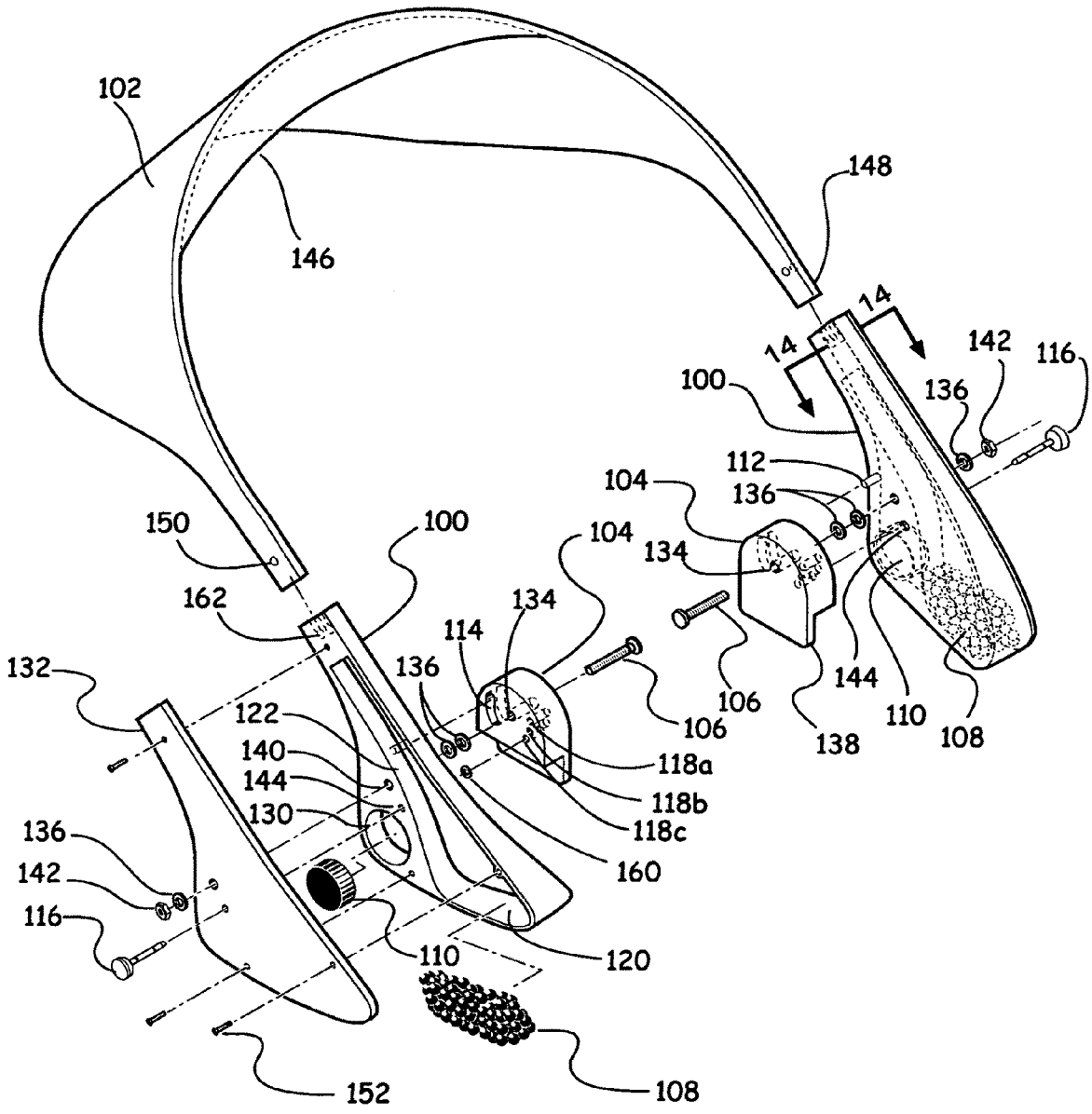
FIG. 5 is an exploded view of the visor apparatus showing the various components that are described in the preferred embodiment.

One embodiment of this visor/shield apparatus is illustrated in FIG. 1*a* thru FIG. 12 and is shown affixed to a common hardhat 101. A protective shield 102 designed for the purpose of protecting a user's face from hazards such as falling objects, flying debris, sparks, splashing fluids bright lights etc. . . . composed of a transparent polycarbonate resin, or similar material, is mounted to housing assembly 99 which is secured to, and pivots on, a pivot arm 106. The combination of the shield 102 and the housing assembly 99, will be referred to as the visor assembly 98 throughout the remainder of this application (See FIG. 2).

The housing assembly 99 contains a plurality of shifting weights 108 and fixed pendulum weight 110. The pendulum weight 110 resides in cavity 130 and maintains a fixed position in the weight housing 100. This plurality of shifting weights 108 are of a shape, size and consistency that allows them to move freely and independently of one another throughout the main cavity 120 of the housing assembly 99. The housing assembly 99 is also made of non-corrosive material such as injection molded polycarbonate, or material of the same, which will allow for the housing to assume a multitude of aesthetic shapes, forms, and colors which will be discussed later in the Conclusions, Ramifications and Scope of this application.

A pivot arm 106 to which the visor assembly 98 is secured to, and pivots on, extends outward through a hole 134 that protrudes from the mounting block 104. In this embodiment, the mounting block 104 has a tab 138 extending from the bottom of said block that is of such a shape that a slot 154, that is universal to most hard hats, can snuggly accommodate. The mounting block tab 138 is pressed into slot 154 until the seating surface of the mounting block 156 comes in contact with seating surface 158 of the hardhat slot 154. The mounting block 104 will also be composed of polycarbonate or injection molded material to allow for said mounting block to be fashioned in a multitude of shapes in order to accommodate specific types of headgear and applications (See FIGS. 18, 19 and 20). For instance a Baseball Cap, Headband, light duty, heavy duty etc. Again this will be discussed in more detail later in the Conclusions, Ramifications and Scope of this application.

The visor assembly 98 and the mounting block 104 can move independently of one another along the pivot arm 106 and interact with each other by limiting the amount of up/down movement that occurs along said pivot arm 106. A limiting pin 112 protrudes from the inner side of the housing assembly 99 extending into a limit slot 114 that is cut into the mounting block 104. In this embodiment, friction is reduced between the visor assembly 98 and mounting block 104 with the aid of a plurality of well oiled washers 136 that separate the two components. The visor assembly 98 is free to move up and down until the limiting pin 112 comes in contact with either the upper limiting surface 114*a* or the lower limiting surface 114*b* of the limit slot 114 in the mounting block 104. In this embodiment, the mounting block 104 also incorporates a plurality of locking holes 118*a*, 118*b* and 118*c* which can accommodate a locking peg 116, that extends through a hole 144 in the housing assembly 99. When depressed, the locking peg 116 extends into one of the locking holes in the mounting block 104 and restricts or stops the free, pivotal movement between the visor assembly 98 and the mounting block 104, essentially "locking" the visor in a desired position relative to the headgear 101.

When using this collection of elements and features assembled in the configuration outlined above, the reader will find that this visor/shield apparatus has multiple useful, novel, modes and methods of operation that will become evident in the next section of this application.

Operation—FIGS. 6 Thru 12

Figure 6:
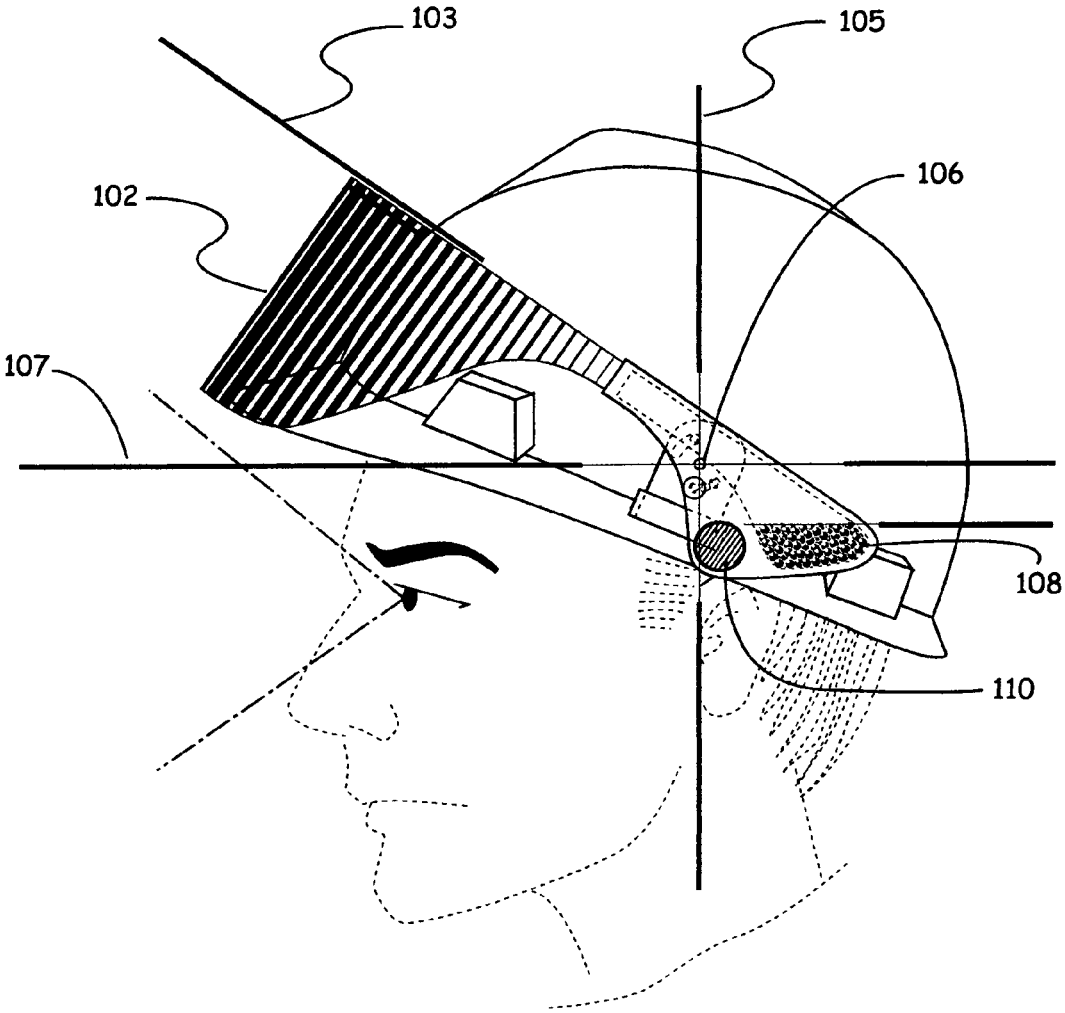
FIG. 6 shows the basic physics that govern the operation of the visor apparatus when the said apparatus is in "counterbalanced/self-positioning mode" and the user begins to tilt their head forward.
Figure 6A:
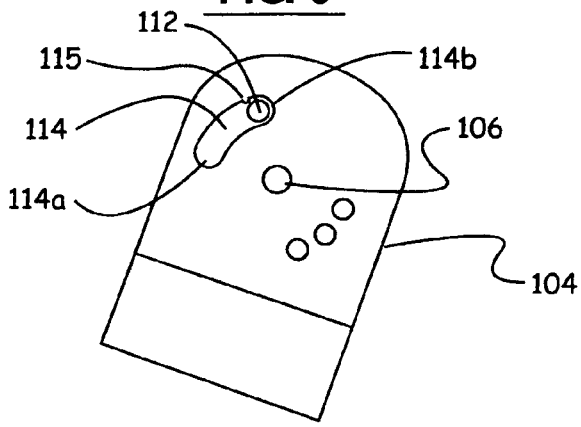
Figure 7:
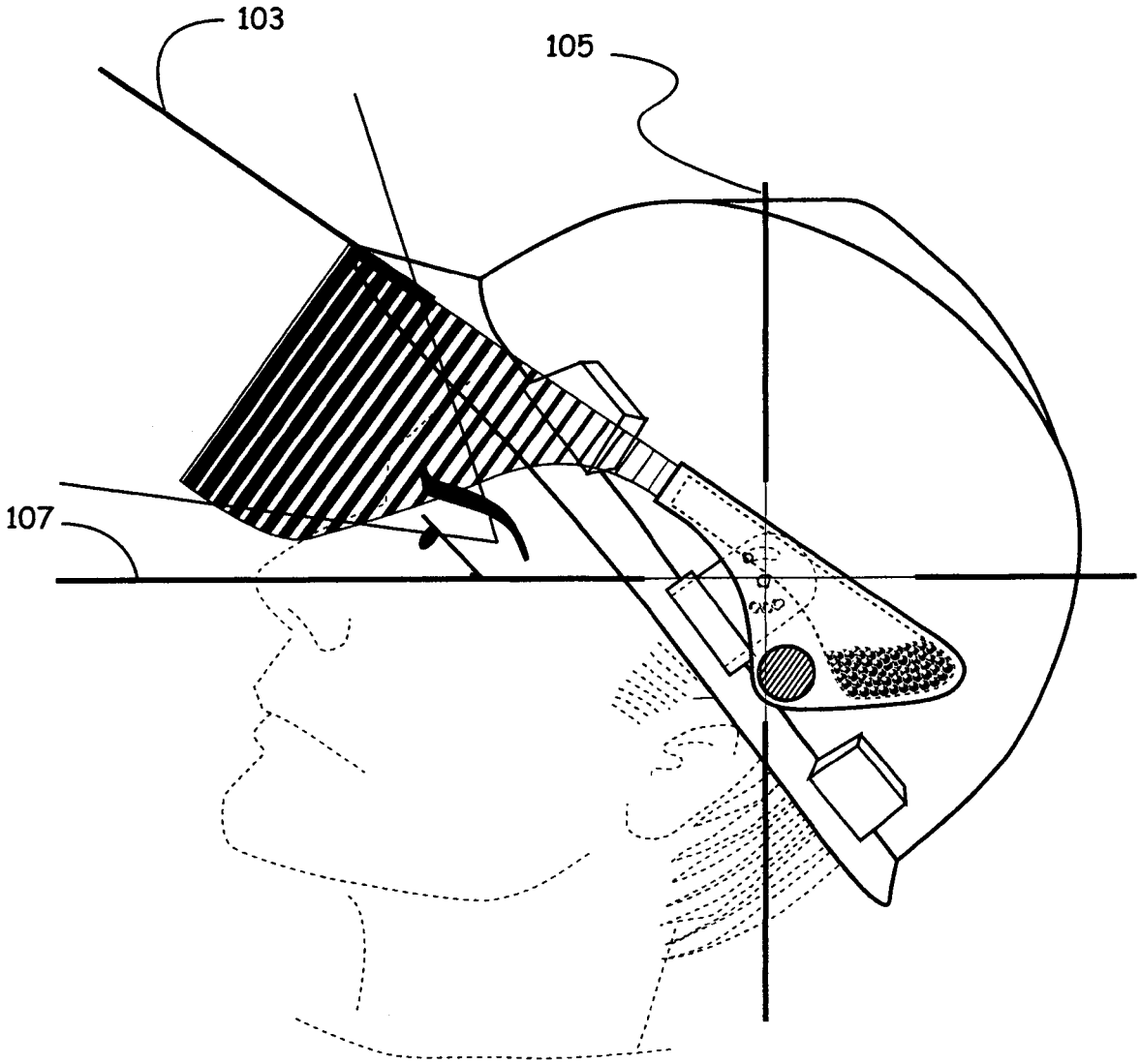
FIG. 7 shows the physics and operation of the visor apparatus when the said apparatus is in "counterbalanced/self-positioning mode" and the user is looking skyward.

The basic physics and operation of the embodiment when used in "self positioning/counterbalanced mode" are illustrated in FIG. 6 and FIG. 7. The visor assembly 98 is essentially a lever that is held in equilibrium at a predetermined angle 103 relative to the "Horizontally Level Plane" 107 with the shield 102 acting as the "load" and the shifting weights 108 that are resting in the rear and mid area 124 and 126 of the housing assembly 99 respectively, of the main cavity 120 acting as the counter weight(s). A pendulum weight 110 is employed to ensure stability and maintain predetermined angle of the visor assembly relative to the headgear 101. The pendulum weight 110 is held slightly to the rear of the "Center of Gravity" 105 by the limiting pin 112 resting against the upper limiting surface 114*b* of the limit slot 114. This offset prevents "bouncing" or unwanted movement of the visor assembly 98 in conditions such as high winds. Furthermore a small protrusion 115 is located on the leading edge of the limit slot 114 to aid in unwanted movement of the visor assembly 99 (See FIG. 6A) Although this said protrusion 115 creates enough resistance to prevent unwanted movement it is not large enough to resist the force of gravity created by the pendulum 110 or to prevent independent movement of the visor assembly 98 when the head of the user exceeds a predetermined angle.

Figure 7A:
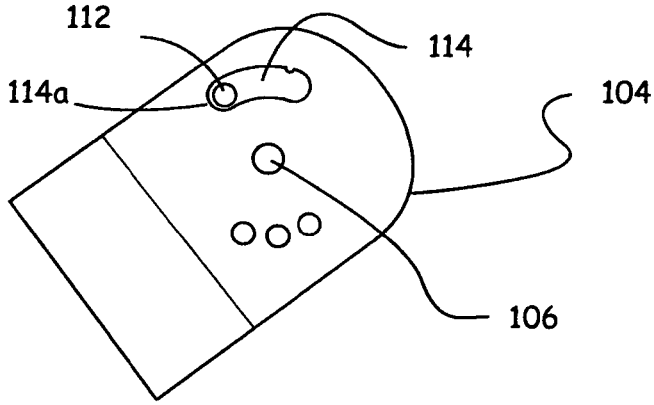
FIG. 7A is a detail showing the relative position of the mounting block limiting slot to the visor assembly's limiting pin as illustrated in FIG. 7.

As illustrated in FIG. 7, when the user looks skyward, and the user eyes become vulnerable to falling debris and dangerous UV rays, the force of gravity acting on the pendulum 110 holds the visor assembly in equilibrium on the pivot arm, at a predetermined angle 103, allowing the shield to move independently of the mounting block 104 and the shield 102 is now in positioned into the field of view of the user. In this embodiment the independent movement of the visor assembly 98 relative to the mounting block 104 is stopped when the limit pin 112 comes in contact with the down limiting surface 114*a* of the limit slot 114 (See FIG. 7*a*) Also in this embodiment, the independent motion of the visor assembly 98 is also stopped by the brim of the hardhat coming in contact with the underside of the shields top lip 146. When the user returns to looking forward the visor assembly 98 remains at, or returns to, the "up position" (See FIG. 1*a*) relative to the head gear 101 and is now positioned out of the users field of view. No hand manipulation is needed to make this transition. The user can now see without their field of view being obstructed by a tinted, dirty or scratched shield.

This apparatus also works in reverse, and will "self-position" into the users field of view when the user tilts their head forward, exceeding a predetermined angle and the visor is in "self-positioning/counterbalanced mode" although the principles and physics of operation are slightly different. As a user tilts their head down to perform tasks such as grinding metal, mixing chemicals, or welding which makes their eyes and face vulnerable to sparks, splashes and bright light, the limit pin 112 affixed to the housing assembly 99 comes in contact with the upper limiting surface 114*b* of the limit slot 114, causing the shifting weights 108 contained within the main cavity 120 to start moving forward as shown in FIG. 8. As the shifting weights 108 pass by the housing cavity's "Center of Gravity" 122 relative to the pivot arm 106 the visor assembly 98 is no longer "counterbalanced". With the shifting weights now in the forward area 128 of the main cavity 120, the visor assembly 99 pivots forward and essentially comes down into the user's field of view (See FIG. 9). In this embodiment, this downward motion is stopped by the limit pin 112 affixed to the weight housing 100 coming in contact with the down limiting surface 114*a* of the limit slot 114 on the mounting block 104 (See FIG. 9*a*) and the under surface of the top lip of the shield 146 coming in contact with the brim of the hard hat. The user is now shielded from the hazards below. No hand manipulation is needed to make this transition.

Figure 11A:
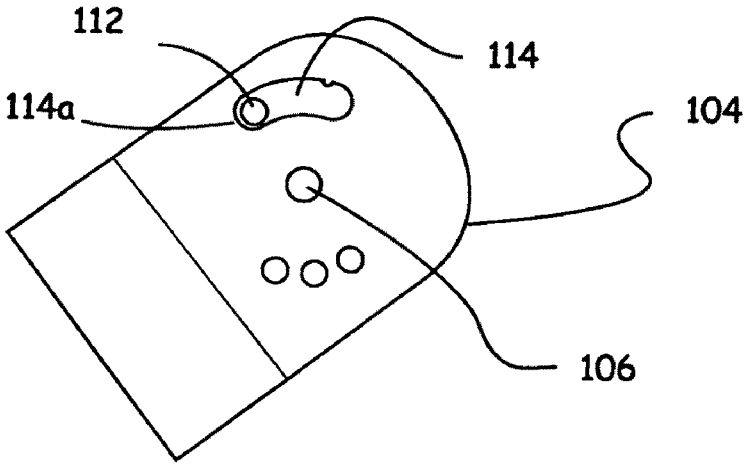

As the user raises their head to a forward looking position, the limit pin 112, being in contact with the down limiting surface 114*a* of the limit slot 114 causes the shifting weights 108 to return rear side of the pivot point and come to rest in mid area 126 of the main cavity 120 in the housing assembly 99. When the shifting weights 108 are in this said mid area of the main cavity 120, the visor is still not "counterbalanced" on the pivot arm 106, at a predetermined angle, and the visor assembly 98 will remain in the down position (See FIG. 10). In order for the user to fully raise the visor assembly 98 out of the field of view, the user must tilt their head skyward, which causes the weights 108 to shift into the mid 124 and rear 126 areas of the main cavity 120 which will cause the visor assembly to be "counterbalanced" and will now be positioned at a predetermined angle 103 , out of the user's field of view. (See FIGS. 11 and 11*a*) No hand manipulation is required to raise the shield out of the field of view.

At any time the user may lock the shield in a desired position by using one finger to depress the locking peg 116 that extends through the housing assembly 99 (See FIG. 12). In this embodiment, the locking peg 116 is received by locking holes 118 that exist in the mounting block 104. This prevents the independent movement of the shield assembly 98 relative to the mounting block 104.

The always up position will allow for full unobstructed/unprotected vision no matter which position the head is in. (See FIG. 1*a*)

The middle position will allow for unobstructed/unprotected vision from eye level down and protected/obstructed vision from eye level up no matter which position the head is in. (See FIG. 1*d*)

The always down position will allow for full obstructed/protected vision no matter which position the head is in. (See FIG. 1*c*)

Conclusion, Ramifications and Scope

As described previously in this application, the apparatus, in some instances, provides an automatic means of positioning a visor or shield into a user's field of view to protect the face and eyes from falling debris, and dangerous UV rays when the user is looking skyward, This is referred to as the "counterbalanced mode". In other instances, the same embodiment described, provides for a hands free method of lowering and raising the visor in and out of the user's field of view. This operation is performed by the tilting of one's head to perform these functions, and does not require hand manipulation. This described method and means of controlling the position of a protective shield is referred to as "self-positioning" and should not be limited to a "construction visor", but may be used to position other forms of eyewear and face protection in and out of the user's field of view.

Some other types of eyewear that may be used with, and controlled by this means and method include, but are not limited to, sunglasses, reading glasses, welding helmets, and surgical shields (See FIGS. 19 and 20). Additionally there are other methods and configurations that may be employed to mount this device to a user's head. The mounting block described herein, which relies on a tab protruding from the bottom that is inserted into a slot on the side of a hardhat, may be replaced by clip that mounts to a baseball cap (See FIG. 17). In some cases the mounting block may even be replaced by a headband (See FIGS. 19 and 20) that incorporates or employs the same functions as the mounting block described previously. That is to say, the means that hold the visor in a relative position to the users head will need to have the same interactive properties as the described mounting block and will be considered to be the same in essence. Also the shield previously illustrated and described in this application can have varying thicknesses and levels of opacity depending on the application of use. For instance a welder may need a very dark shield, that is relatively thick and capable of withstanding heat However, a chemist or surgeon may need a totally transparent, lightweight, disposable shield. These various applications may employ the same means and methods to control the position of the visor without hand manipulation.

Other ramifications concern the aesthetic shape of the assembly described in the previous sections of this application, particularly the shape of the weight housing 100. As shown in F*ig*. 18, the housing may assume different shapes, and in this case, the housing may resemble some kind of wing. Other shapes can be used, as long as the basic elements are contained within the housing, namely the shifting weights and pendulum.

Additionally, other means and methods may be employed to lock and unlock the visor assembly as shown in FIG. 16 which incorporates a "rocker button" to engage and disengage the locking peg. Furthermore, even the locking peg concept itself may be replaced another means as long as the independent movement between the housing and the visor assembly is restricted by the means.

Thus the scope of the embodiment should be determined by the appended claims and their legal equivalents, rather than the examples given.

I claim:

1. A counter balanced, hands free, self positioning, protective shield in combination with headwear comprising:

a shield assembly, the shield assembly comprising:

a shield acting as a load to a counter balance weight; the shield having a left and right side, each said left and right side of the shield comprises: a shield retaining tab protrusion coupled to a weight housing; and a mounting block configured to couple to each said weight housing, wherein the mounting block and said weight housing are pivotally coupled together, the mounting block comprising: a seating surface; a mounting block tab; and a plurality of locking holes; wherein said weight housing comprises a housing cover fitting over a housing unit that comprises: a cavity; the cavity contains a plurality of shifting weights acting as the counter balance weight, wherein said plurality of shifting weights are of shape, size, and consistency that allows them to move freely and relatively independent of one another throughout the cavity; a housing pivot hole; and a pendulum weight cavity; the pendulum weight cavity housing a pendulum which ensures stability and maintains a predetermined counterbalanced angle relative to a horizontally level plane of the shield assembly.

2. The counter balanced, hands free, self positioning, protective shield of claim 1, wherein the weight housing further comprises a housing shield retaining dimple.

3. The counter balanced, hands free, self positioning, protective shield of claim 2, wherein the shield retaining tab protrusion of the shield assembly fits within the housing shield retaining dimple of the housing unit.

4. The counter balanced, hands free, self positioning, protective shield of claim 1, further comprising a pivot arm coupling the mounting block to the weight housing.

5. The counter balanced, hands free, self positioning, protective shield of claim 1, wherein the mounting block further comprises: a limit slot, the limit slot further comprising: a limit slot protrusion; and a lower and an upper limiting surface.

6. The counter balanced, hands free, self positioning, protective shield of claim 1, wherein the weight housing further comprises a locking peg hole which receives a locking peg for locking the shield in a desired position.

7. The counter balanced, hands free, self positioning, protective shield of claim 1, wherein the mounting block further comprises a mounting block pivot hole.

8. The counter balanced, hands free, self positioning, protective shield of claim 1, wherein the plurality of locking holes locks the shield assembly in a down, middle, or up position.

9. The counter balanced, hands free, self positioning, protective shield of claim 8, further comprising a pivot arm coupling the mounting block to the weight housing.

10. The counter balanced, hands free, self positioning, protective shield of claim 8, wherein the mounting block further comprises: a limit slot comprising:

a limit slot protrusion; and a plurality of limiting surfaces.

11. The counter balanced, hands free, self positioning, protective shield of claim 8, wherein the weight housing further comprises a plurality of holes locking the shield assembly at a plurality of angles.

12. The counter balanced, hands free, self positioning, protective shield of claim 11, wherein one of the plurality of holes of the weight housing is a locking peg hole which receives a locking peg for locking the shield in a desired position.

13. The counter balanced, hands free, self positioning, protective shield of claim 8, wherein the mounting block further comprises a mounting block pivot hole.

14. A counter balanced, hands free, self positioning, protective shield, for headwear comprising:

a shield acting as a load to a counter balance weight; the shield having a left and right side, each said left and right side of the shield comprises: a weight housing comprising a housing shield retaining dimple receiving a shield retaining tab protrusion of a shield assembly; a mounting block pivotally coupled to the weight housing, the mounting block comprising: a substantially flat horizontal mounting surface; a substantially flat vertical mounting surface, wherein the horizontal and vertical mounting surface is configured to couple to the headwear; and a plurality of locking holes; a housing unit of the weight housing comprising: a cavity; the cavity housing a plurality of shifting weights acting as the counter balance weight, wherein said plurality of shifting weights are of shape, size, and consistency that allows them to move freely and relatively independent of one another throughout the cavity; and a pendulum weight cavity; the pendulum weight cavity housing a pendulum which ensures stability and maintains a predetermined counterbalanced angle relative to a horizontally level plane of the shield assembly; and a housing cover fitting over the housing unit.

* * * * *